United States Patent [19]

Pritts

[11] Patent Number: 4,998,389

[45] Date of Patent: Mar. 12, 1991

[54] VARIABLE PITCH ROOF RIDGE BEAM ASSEMBLY AND COMPONENTS THEREOF

[75] Inventor: William V. Pritts, Scottdale, Pa.

[73] Assignee: Outside-In, Inc., Connellsville, Pa.

[21] Appl. No.: 475,457

[22] Filed: Feb. 6, 1990

[51] Int. Cl.[5] ..... E04B 7/06

[52] U.S. Cl. ..... 52/90; 52/645

[58] Field of Search ..... 403/65, 113, 121, 122; 52/66, 71, 72, 640, 641, 90, 92, 645, 397–403; 47/17

[56] References Cited

U.S. PATENT DOCUMENTS

| | | | |
|---|---|---|---|
| 1,999,219 | 4/1935 | Toney | 52/764 |
| 4,663,896 | 5/1987 | Dunnick | 52/71 |
| 4,724,646 | 2/1988 | Meyers | 52/66 |
| 4,872,297 | 10/1989 | Hetzel et al. | 52/640 |

FOREIGN PATENT DOCUMENTS

| | | | |
|---|---|---|---|
| 2016574 | 9/1979 | United Kingdom | 52/71 |

OTHER PUBLICATIONS

English Greenhouse Corporation Publication, 5 pages dated may, 1985.

*Primary Examiner*—James L. Ridgill, Jr.
*Attorney, Agent, or Firm*—Carothers and Carothers

[57] ABSTRACT

An assembly for securing roof panels at selectable pitch angles includes a ridge beam having a horizontal ledge for contacting the underside of the upper edge of roof panels and a horizontally extending drip flange which overlies this ledge and provides a downwardly open cap channel. A sealing strip of elongated elastomeric material is slidably received in this cap channel and also is provided with a downwardly open flange channel therein which coextends therewith and receives and grips the upper edge of an elongated ridge cover flange therein and the lower portion of the cover flange extends over the top of the upper edge of the roof panels. This ridge cover flange is thus permitted to pivotly adjust vertically within the elastomeric strip to mate with the pitch of the roof panels to be covered by the cover flange at the upper ends of the roof panels. The roof panels are supported by roof support bars or rafters which in turn are supported at their upper ends from the ridge beam by pivot brackets, which, in turn, are comprised of a ridge clip support for securement to the ridge beam, which support is provided with a shelf having an upperwardly facing concave seat, and a ridge clip for securement to the upper end of a rafter beam. The ridge clip has a head portion that rests on the seat of the ridge clip support for vertical pivotal hinge movement of the clip.

14 Claims, 2 Drawing Sheets

VARIABLE PITCH ROOF RIDGE BEAM ASSEMBLY AND COMPONENTS THEREOF

BACKGROUND

This invention relates generally to an assembly for supporting roof panels at selected pitch angles and standardized components thereof which can be adjusted to provide the selected roof pitch.

The variable pitch ridge beam assembly of the present invention is particularly adaptable to lean-to type structures which are added to new or existing construction, the most popular of which are referred to as solar or sun rooms, in which at least a greater portion of the roof and walls are constructed of glass pannels. Of course, solid pannels may be substituted for the glass pannels where and as desired.

A better understanding of the background of the present invention may be obtained by referring to U.S. Pat. No. 4,724,646 which issued on Feb. 16, 1988 for Variable Pitch Roof Support Assembly And Components Thereof.

When constructing a variable pitch ridge beam assembly for supporting roof panels at selectable pitch angles, it has to be kept in mind that these lean-to or sun room structures will be going out to many different contractors with varied experience for erection. Accordingly, the lean-to construction and assembly must be as simple as possible and readily understood by all contractors who will have to construct the sun room package, yet provide a structure which is effectively sealed from the elements. This problem is even further complicated when attempting to incorporate a variable pitch roof assembly into the lean-to structure.

Existing variable pitch beam assemblies are plagued with problems of either inadequate weather sealing or they are over complex.

For example, all existing variable pitch ridge beam assemblies incorporate a ridge cover flange, which is in some manner secured to the ridge beam and overlies the top of the roof panels to seal the upper edge of the roof pannels from the outside elements. However, some rely on caulking as the only and final seal between the cap or cover flange and the ridge beam.

For example in one variable pitch beam assembly presently on the market, the horizontally extending ridge cover flange that covers the top of the roof panels has an upwardly extending and coextending flange extension portion that is secured to the ridge beam by nails or screws and this portion of the cover flange permits the entire flange to vertically rock up or down against the ridge beam on the nails or screws so that the bottom portion of the cover flange that over laps the roof panels will mate with the roof panels for the designated variable pitch that is selected for the roof.

This construction means that the screws or nails must pass through a portion of the cover flange thereby providing areas for possible air leaks and water leaks, and in addition, an air tight seal is not provided between the ridge beam and the cover flange.

Another type of variable ridge beam assembly, as is illustrated in U.S. Pat. No. 4,724,646, which issued on Feb. 16, 1988 for Variable Pitch Roof Support Assembly And Components Thereof, apparently provides an effective seal, unlike the above-mentioned product, but it is more complex and expensive to manufacture and install. In this patented structure, a long horizontally extending arcuate flange projects laterally outward from the ridge beam and curves downward, and this arcuate flange is further provided with longitudinal grooves so that this arcuate elongated flange may be shortened by breaking off longitudinal segments thereof along these longitudinal grooves or scores so that the arcuate flange will meet the roof panels at their selected pitch. In addition, this arcuate downwardly curving cover flange is not of a flexible nature in that the flange as a whole cannot pivot and therefore the cover flange as a whole cannot pivot to meet slight variations in roof pitch, as the ridgid arcuate flange is designed to be broken off only at specific or along designated break points. In addition, because the arcuate ridgid flange in an integral extruded part of the ridge beam, there is no thermal break between the cover flange and the ridge beam.

It is an important object of the present invention to provide a variable pitch ridge beam assembly which is inexpensive to manufacture and assemble and which is also convenient and readily understood by construction personnel, thereby minimizing any possible construction errors while still providing a quality variable pitch ridge beam assembly which will not leak and which further provides a maximum seal from the elements.

SUMMARY OF THE INVENTION

The variable pitch ridge beam assembly of the present invention is provided for supporting roof panels at selectable pitch angles. The assembly comprises an elongated generally horizontally extending ridge beam which forms a ridge support for roof panels. This ridge beam is provided with a vertically extending base portion.

A ledge projects laterally from an extends generally horizontally along the base portion of the beam for contacting the upper edge of the roof panels thereon.

The ridge beam is further provided with a horizontally extending cap or drip flange which projects laterally outward from the base portion above the aforedescribed ledge and this drip flange is further provided with a downwardly open cap channel coextending with the ridge beam overlying the aforedescribed ledge.

An elongated elastomer strip is slideably received upwardly into this cap channel with sealing engagement and the elastomer strip is further provided with an elongated coextending and downwardly open flange channel. A ridge cover flange extends over the entire top of the upper edge of the roof panels and this cover flange further has an upwardly extending and coextending flange extention portion that is snugly received in the downwardly open flange channel of the elastomer strip. Accordingly, this elastomer strip seals the upper horizontally extending edge of the cover flange with the ridge beam structure and also permits the cover flange to be pivoted vertically to accomodate different roof panel pitch. To further accomodate this pivotal action of the cover flange, the elastomer strip may be slid upward or downward within the cap channel of the ridge beam to preselectable sealing positions.

To further insure a good seal between the cover flange and the roof panels, seal means may be provided therebetween, for example, in the form of a glazing tape.

The variable pitch ridge beam assembly may also include a plurality of rafter beams that extend downwardly from the ridge beam to support the roof covering or panels. These rafter beams are pivotally supported at their upper ends to provide a variable pitch for the roof.

The pivotal connection of the rafters to the ridge beam is provided, as another feature of the present invention, in the form of a pivot bracket, which includes a ridge clip support for securement to the ridge beam and a ridge clip for securement to the upper end of each rafter beam, whereby the ridge clips are pivotally hinged to the ridge clip supports for vertical pivotal hinge movement of clips on the supports.

These ridge clips are provided with a shelf having an upwardly facing concave seat and the corresponding ridge clips have a head portion which respectively rests on the respective seats of the clip supports for vertical pivotal hinge movement of the clip thereon.

As an additional inventive feature, an arcuate shaped lock flange extending downwardly from the ridge clip may pertrude under this aforedescribed shelf on the clip support thereby preventing the clip head from being accidentally dislodged from the seat by upward acting forces which may act on the clip or the roof, such as updrafts.

BRIEF DESCRIPTION OF THE DRAWINGS

Other objects and advantage appear in the following description and claims.

The accompanying drawings show, for the purpose of exemplification without limiting the invention or the claims thereto, certain practical embodiments illustrating the principals of this invention wherein:

DETAILED DESCRIPTION OF A PREFERRED EMBODIMENT

Figure 1:
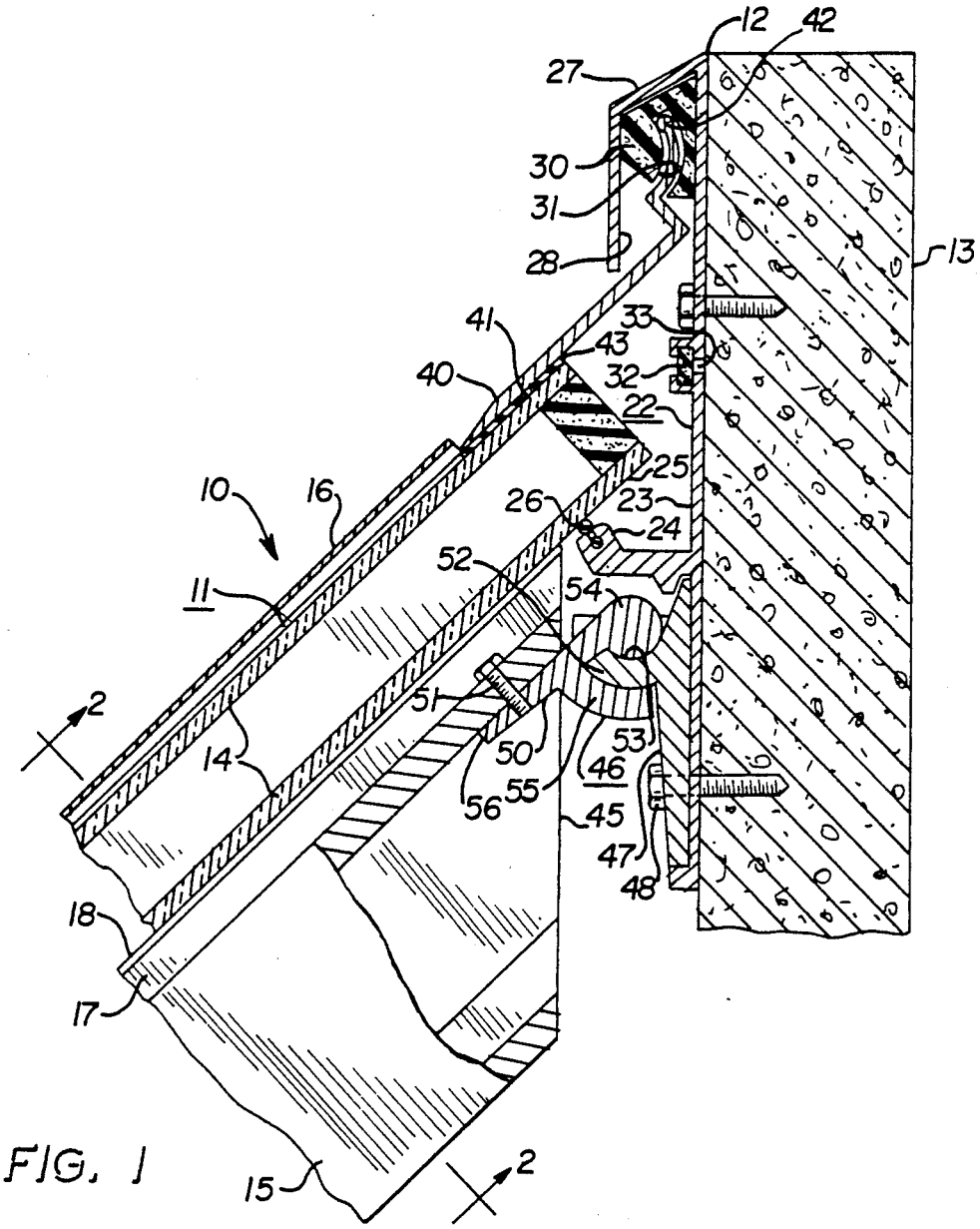
FIG. 1 is a vertical transverse sectional view through a lean-to structure illustrating one embodiment of the variable pitch roof beam assembly of the present invention.
Figure 2:
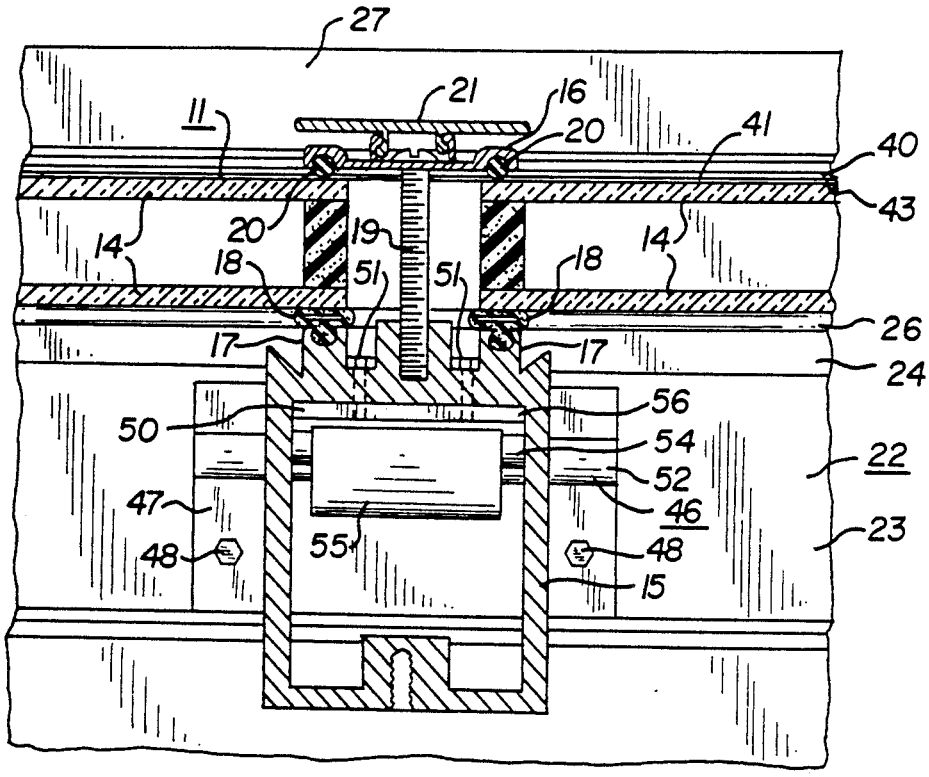
FIG. 2 is a longitudinal sectional view taken along section line 2—2 through the lean-to structure of FIG. 1.

Referring to FIG. 1, a lean-to structure 10 is illustrated in accordance with the invention which includes a roof 11 of a given single pitch as illustrated, and which is secured at the ridge 12 to a vertical portion of a main structure 13. As may be seen in reference to both FIGS. 1 and 2, the roof 11 includes panels 14 of double pane glass, glazing or rafter beams 15 running from the ridge to the eaves (not shown), and sealing bars 16. The main glazing bars or rafter beams 15 are hollow, generally rectangular, and are perferrably constructed of aluminum extrusions which have upwardly projecting longitudinal ribs 17 upon which adjacent glass panels 14 are supported with thermal break material 18 inbetween. The glass panels are clamped in place by the sealing bar 16 which is secured to the rafter beam 15 at spaced locations by screws 19. Sealing strips 20 make the connection water tight, and cap strips 21 snap into the sealing bar 16 to conceal screws 37 and provide a decorative finish. Cap strip 21 is shown in FIG. 2 only in order to minimize confusion in illustration.

An elongated horizontally extending ridge beam 22 is provided which forms in ridge support for roof panels 14. Ridge beam 22 has a generally vertically extending base portion 23 and a ledge 24 projecting laterally from and extending horizontally along base portion 22 for contacting the upper bottom edge 25 of roof panels 14. Elongated elastomeric seal 26 extends horizontally along ledge 24 for contacting roof panels 14 in sealed engagement.

Ridge beam 22 is also normally extruded of a suitable metal such as aluminum in one piece. However, in order to provide a thermal break between the lower portion and the upper portion of the horizontal ridge beam 22, a conventional thermal gap 32 of a molded insulation material is provided. After this molded material has been poured and set, then the beam 22 is cut for its entire length longitudinally to provide a gap 33, thereby providing a thermal break, which is a conventional means of doing so in the industry.

Ridge beam 22 is also provided at the upper end thereof with a horizontally extending cap or drip flange 27 projecting laterally outward from base portion 23 above and over ledge 24. Drip flange 27 is further provided with a downwardly open cap channel 28 which horizontally coextends therewith and overlies ledge 24.

An elongated elastomeric strip 30 is received in cap channel 28 with sealing engagement. This elastomeric strip 30 may also be slideably adjusted up or down therein. This elastomeric strip 30 extends longitudinally for the entire length of the roof structure.

Figure 4:
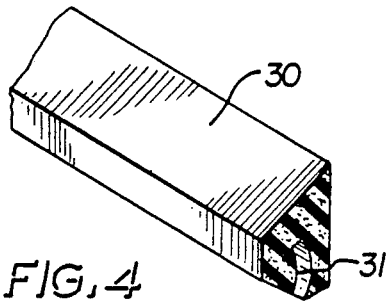
FIG. 4 is an isometric view of the elastomeric strip portion of the structure of FIG. 1.

The elastomeric strip 30 in turn is provided with a downwardly open flange channel 31 which coextends therewith for its entire length. Elastomeric strip 30 is constructed of any suitable plyable or elastomeric material, such as a plastic or synthetic rubber, and would normally be manufactured by conventional extrusion processes. Elastomeric strip 30 is independently shown in FIG. 4.

Figure 3:
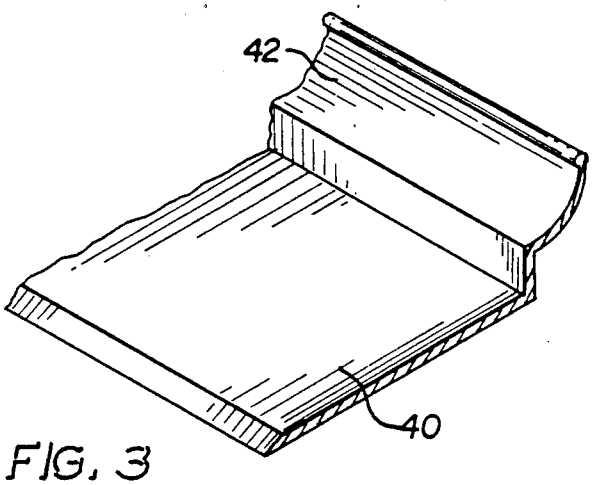
FIG. 3 is an isometric view of the ridge cover flange portion of the structure of FIG. 1.

An elongated ridge cover flange 40 extends over the entire top of the upper edge 41 of roof panels 14 to seal off the elements between the ridge beam 23 and all of the roof panels. This elongated horizontally extending cover flange is illustrated separately in FIG. 3.

Cover flange 40 is further provided with an upwardly extending and coextending flange extension portion 42 which is received within the flexible flange channel 31 of elastomeric strip 30 with sealing engagement thereby permitting the ridge cover flange to pivotally adjust vertically to mate with the pitch of roof panels 14. In addition, as the roof pitch of panels 14 varies, elastomeric strip 30 may be slidably adjusted either upward or downward within its receiving cap channel 28 to provide even greater accuracy and infinite adjustment, thereby imparting cover flange 42 with the ability to perfectly match the pitch of roof panels 14. Elastomeric strip 30 further provides a very thorough seal between cover flange 40 and ridge beam 22 thereby providing not only an effective seal from the elements but a thermal break between flange 40 and beam 22, which are both constructed of heat and cold conducting metal. Obviously, either flange 40 or ridge beam 22 could be alternatively constructed of an extruded plastic or the like.

An additional seal is also provided between cover flange 40 and the upper ends 41 of roof panels 14 in the form of glazing tape 43.

The roof panels 14 are supported by a plurality of rafter beams 15, as previously explained, and these rafter beams 15 extend downwardly from ridge beam 22 and are pivotally supported therefrom at their upper ends 45 by pivot brackets 46.

The pivot brackets 46 are comprised of a ridge clip support 47 which is secured to ridge beam 22 by bolts 48, and a ridge clip 50, that is pivotally supported on clip support 47 and secured by screws 51 to respective of the rafter beams 15.

Figure 5:
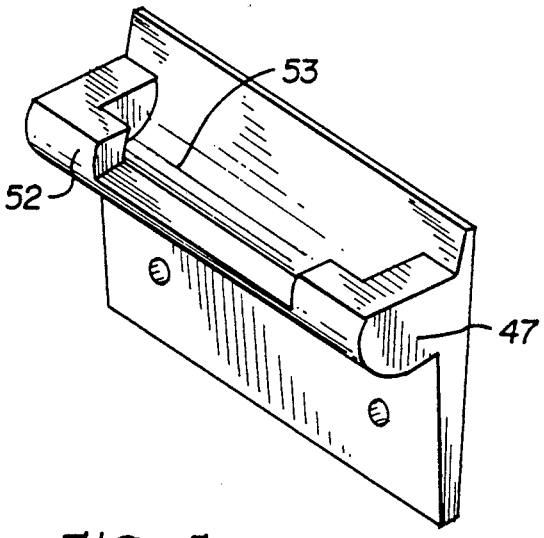
FIG. 5 is an isometric view of the ridge clip support portion of the hinge assembly shown in FIG. 1.
Figure 6:
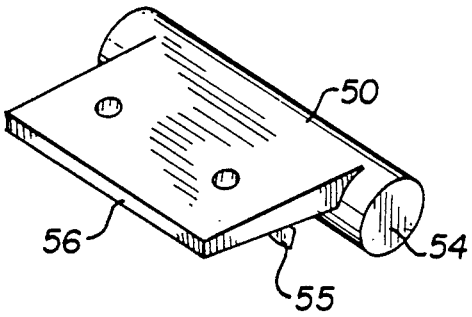
FIG. 6 is an isometric view of the ridge clip portion of the hinge assembly portion of the variable pitch roof ridge beam assembly shown in FIG. 1.

These two parts comprising the pivot bracket 46 are best illustrated separately in FIGS. 5 and 6.

Ridge clip support 47 is provided with a shelf 52 having an upward facing concave seat 53 pivotally supporting the head portion 54 of ridge clip 50, which head portion rests on seat 53 of clip support 47.

Ridge clip 50 is further provided with an arcuate shaped lock flange 55 which protrudes downwardly therefrom under the shelf 52 of clip support 47 thereby preventing clip 50 from accidentally being dislodged from seat 53 by upwardly acting forces which may act on the clip or the roof structure in general.

As may be best illustrated in FIG. 1, the upper ends 45 of rafter beams 15 may be cut off in an appropriate angle and the tongue portion 56 of clip 50 protrudes into the hollow interior of the upper end of extruded rafter beam 15 for securement of screws 51.

I claim:

1. A variable pitch ridge beam assembly for supporting roof panels at selectable pitch angles comprising, an elongated generally horizontally extending ridge beam forming a ridge support for roof panels and having a generally vertically extending base portion, a ledge projecting laterally from and extending generally horizontally along said base portion for contacting the upper edge of roof panels thereon, a generally horizontally extending drip flange projecting laterally outward from the base portion above said ledge and having a downwardly open cap channel coextending therewith over said ledge, elongated elastomeric means received in said cap channel with sealing engagement, said elastomeric means having a downwardly open flange channel coextending therewith, and an elongated ridge cover flange for extending over the top of the upper edge of roof panels to be contacted on said ledge and having a generally upwardly extending and coextending flange extension portion received in said flange channel with sealing engagement thereby permitting said ridge cover flange to pivotally adjust vertically to mate with the pitch of roof panels to be covered thereby at their upper ends.

2. The variable pitch ridge beam assembly of claim 1 including an elongated elastomeric seal generally extending horizontally on said ledge for contacting roof panels.

3. The variable pitch ridge beam assembly of claim 2 including roof panels having their upper ends received between said ledge and said cover flange.

4. The variable pitch ridge beam assembly of claim 3 including seal means between said cover flange and said roof panels.

5. The variable pitch ridge beam assembly of claim 4 wherein said roof panels are glass.

6. A variable pitch ridge beam assembly comprising, an elongated generally horizontally extending ridge beam having a downwardly open channel coextending therewith and generally vertically extending back plate means for securement to a building structure, a plurality of rafter beams extending downwardly from said ridge beam and pivotally supported therefrom at their upper ends, roof covering means supported by said rafter beams, elongated elastomeric strip means slidably received in said channel with sealing engagement and coextending for at least the horizontal span of said roof covering means, said elastormeric strip means having a downwardly open flange channel coextending therewith, and a ridge cover flange horizontally extending over the upper end of said roof covering means and having an upwardly extending and coextending flange extension portion received in said flange channel with sealing engagement thereby permitting said flange to pivotally adjust vertically to mate with the pitch of said roof covering means.

7. The variable pitch ridge beam assembly of claim 6 including seal means between the bottom of said ridge cover flange and said roof covering means.

8. The variable pitch ridge beam assembly of claim 6, wherein said roof covering means includes transparent window panels supported on said rafter beams.

9. The variable pitch ridge beam assembly of claim 6, wherein the pivotal connections of said rafter beams to said ridge beam each comprises a ridge clip support secured to said ridge beam and a ridge clip pivotally supported therefrom, each of said ridge clips being secured to respective of said rafter beams.

10. The variable pitch ridge beam assembly of claim 9, wherein said pivotal connection consists of a shelf on said clip support having an upwardly facing concave seat pivotally supporting a head portion of said clip resting therein.

11. The variable pitch ridge beam assemly of claim 10, wherein said ridge clip includes an arcuate shaped lock flange protruding under said shelf on said clip support preventing said clip from accidentally being dislodged from said seat by upwardly acting forces which may act on said clip.

12. The variable pitch ridge beam assembly of claim 10, wherein said rafter beams are tubular and said ridge clips protrude into the hollow interior thereof at the upper ends of said rafter beams and are therein secured.

13. A pivot bracket for connecting a roof rafter beam to a generally horizontal ridge beam at a selectable pitch angle comprising, a ridge clip support for securement to a ridge beam and having a shelf with an upwardly facing concave seat, a ridge clip for securement to the upper end of a rafter beam and having a head portion resting on said seat for vertical pivotal hinge movement of said clip thereon.

14. The pivot bracket of claim 13 wherein said ridge clip includes an arcuate shaped lock flange protruding under said shelf on said clip support preventing said clip head from accidentally being dislodged from said seat by upwardly acting forces which may act on said clip.

* * * * *